US009099813B1

(12) United States Patent
Trout et al.

(10) Patent No.: US 9,099,813 B1
(45) Date of Patent: Aug. 4, 2015

(54) ELECTRICAL CONNECTOR ASSEMBLY HAVING A CONTACT ORGANIZER

(71) Applicants: Tyco Electronics Corporation, Berwyn, PA (US); TE Connectivity Nederland B.V., AR's-Hertogenbosch (NL)

(72) Inventors: David Allison Trout, Lancaster, PA (US); Richard Elof Hamner, Hummelstown, MO (US); James Lee Fedder, Etters, PA (US); Timothy Robert Minnick, Enola, PA (US); Hubertus Maria Van Het Bolscher, Tilburg (NL); Rutger Wilhelmus Smink, Hamont-Achel (BE); Leo Joseph Graham, Hershey, PA (US); Thomas Taake De Boer, Hummelstown, PA (US)

(73) Assignees: Tyco Electronics Corporation, Berwyn, PA (US); TE Connectivity Nederland B.V., s'Hertogenbosch (NL)

( * ) Notice: Subject to any disclaimer, the term of this patent is extended or adjusted under 35 U.S.C. 154(b) by 0 days.

(21) Appl. No.: 14/194,109

(22) Filed: Feb. 28, 2014

(51) Int. Cl.

| | |
|---|---|
| ***H01R 13/648*** | (2006.01) |
| ***H01R 13/6588*** | (2011.01) |
| ***H01R 13/652*** | (2006.01) |
| *H01R 13/6587* | (2011.01) |

(52) U.S. Cl.
CPC ..... *H01R 13/6588* (2013.01); *H01R 13/652* (2013.01); *H01R 13/6587* (2013.01)

(58) Field of Classification Search
CPC ..... H01R 13/6587
USPC ..... 439/607.1, 607.07, 79, 108
See application file for complete search history.

(56) References Cited

U.S. PATENT DOCUMENTS

| | | | | |
|---|---|---|---|---|
| 7,927,143 | B2 | 4/2011 | Helster et al. | |
| 7,931,500 | B2 * | 4/2011 | Knaub et al. | 439/607.07 |
| 7,967,637 | B2 * | 6/2011 | Fedder et al. | 439/607.06 |

* cited by examiner

*Primary Examiner* — Tho D Ta

(57) ABSTRACT

Electrical connector assembly including an electrical connector having signal contacts and ground contacts that are coupled to a connector housing and disposed along a mounting side of the connector housing. The electrical connector assembly also includes a contact organizer that is positioned along the mounting side of the connector housing. The contact organizer has signal windows and ground passages extending therethrough that are defined by respective inner surfaces of the contact organizer. The ground contacts engage the inner surfaces of the ground passages when the contact organizer is held in a pre-loaded position away from the mounting side. The contact organizer moves to a seated position against the mounting side when the electrical connector is mounted to the circuit board. Each of the signal contacts is surrounded by an air gap that exists between the signal contact and the inner surface of the corresponding signal window.

20 Claims, 5 Drawing Sheets

ELECTRICAL CONNECTOR ASSEMBLY HAVING A CONTACT ORGANIZER

BACKGROUND

The subject matter herein relates generally to electrical connectors and connector assemblies that are mounted to circuit boards in communication systems.

Backplane (or midplane) communication systems, such as network systems, servers, data centers, and the like, include a backplane (or midplane) circuit board having electrical connectors mounted thereto. The backplane communication system is configured to engage multiple daughter card assemblies that each include a circuit board (referred to as a daughter card) and one or more electrical connectors mounted to the daughter card. The electrical connectors of the daughter card assemblies are configured to mate with the electrical connectors of the backplane communication system. The different daughter card assemblies may be communicatively coupled to one another through the backplane circuit board.

The electrical connectors may include dense arrays of signal contacts and ground contacts. The signal and ground contacts have respective contact tails arranged along a mounting side of the electrical connector. The contact tails are configured to be inserted into vias, such as plated thru-holes (PTHs), of the circuit board. The contact tails can be relatively thin and, therefore, susceptible to damage. For instance, if the contact tails and the vias are misaligned when the electrical connector is mounted to the circuit board, the contact tails may press against an exterior surface of the circuit board. In such instances, moving the electrical connector along the circuit board to correctly position the contact tails may bend or otherwise damage the contact tails.

To address this challenge, at least some known electrical connector assemblies include contact organizers that are positioned along the mounting side of the electrical connector. The contact organizer is typically a thin body of dielectric material, such as plastic, having passages defined by inner surfaces of the contact organizer. The contact tails are inserted through respective passages and engage the inner surfaces of the contact organizer. Frictional forces between the contact tails and the inner surfaces may hold the contact organizer at a pre-loaded position away from the mounting side. During the mounting operation, the contact organizer holds the contact tails in a predetermined arrangement and also reinforces the contact tails to reduce the likelihood of damage. Although a contact organizer may be effective in reducing damage and facilitating the mounting operation, the dielectric material of the contact organizer may negatively affect the impedance of the electrical connector and, consequently, the overall performance of the electrical connector.

Accordingly, there is a need for an electrical connector assembly having a contact organizer that protects at least some of the contact tails of the electrical connector while also permitting the electrical connector to obtain a designated electrical performance.

BRIEF DESCRIPTION

In an embodiment, an electrical connector assembly is provided that includes an electrical connector having a connector housing that includes a mating side configured to mate with a communication connector and a mounting side configured to face a circuit board. The electrical connector includes signal contacts and ground contacts that are coupled to the connector housing and disposed along the mounting side. The electrical connector assembly also includes a contact organizer that is positioned along the mounting side of the connector housing. The contact organizer has signal windows and ground passages extending therethrough that are defined by respective inner surfaces of the contact organizer. The ground contacts engage the inner surfaces of the ground passages when the contact organizer is held in a pre-loaded position away from the mounting side. The contact organizer moves to a seated position against the mounting side when the electrical connector is mounted to the circuit board. Each of the signal contacts is surrounded by an air gap that exists between the signal contact and the inner surface of the corresponding signal window when the contact organizer is in the seated position.

In an embodiment, an electrical connector assembly is provided that includes an electrical connector having a connector housing that includes a mating side configured to mate with a communication connector and a mounting side configured to face a circuit board. The electrical connector includes signal contacts and ground contacts that are coupled to the connector housing and disposed along the mounting side. The electrical connector assembly also includes a contact organizer positioned along the mounting side of the connector housing. The contact organizer has signal windows and ground passages extending therethrough that are defined by respective inner surfaces of the contact organizer. The contact organizer is configured to move from a pre-loaded position, in which the contact organizer is separated from the mounting side, to a seated position, in which the contact organizer is pressed against the mounting side. The ground contacts are held in a designated arrangement as the contact organizer moves from the pre-loaded position to the seated position. At least some of the signal contacts move freely through the corresponding signal windows without resistance from the corresponding inner surfaces as the contact organizer moves from the pre-loaded position to the seated position.

In an embodiment, a circuit board assembly is provided that includes a circuit board having an exterior surface and an array of vias extending into the exterior surface. The circuit board assembly also includes an electrical connector that has a connector housing having a mating side configured to mate with a communication connector and a mounting side facing the circuit board. The electrical connector also includes signal contacts and ground contacts coupled to the connector housing and disposed along the mounting side. The circuit board assembly also includes a contact organizer that is positioned between the mounting side of the connector housing and the circuit board. The contact organizer has signal windows and ground passages extending therethrough that are defined by respective inner surfaces of the contact organizer. The ground contacts extend through the ground passages, and the signal contacts extend through the signal windows. Each of the signal contacts is surrounded by an air gap that exists between the signal contact and the inner surface of the corresponding signal window when the electrical connector is mounted to the circuit board.

DETAILED DESCRIPTION

Embodiments set forth herein include electrical connector assemblies and circuit board assemblies including the same. The circuit board assemblies may be used in backplane or midplane communication systems. For example, the circuit board assembly may be a backplane assembly having a mother board and electrical connectors mounted thereto. In other embodiments, the circuit board assembly may be a daughter card assembly having a daughter card and one or more electrical connectors mounted thereto that engage the backplane assembly. Although the electrical connector assemblies and circuit board assemblies set forth herein are described with respect to backplane or midplane communication systems, it is understood that embodiments may be used in other applications.

Various embodiments utilize a contact organizer that holds electrical contacts of the corresponding electrical connector in a designated arrangement. As described herein, the contact organizer may hold ground contacts in predetermined positions with respect to each other and also reinforce the ground contacts during a mounting operation. More specifically, the contact organizer may reduce the likelihood of the ground contacts being damaged as the electrical connector is mounted to a circuit board. The contact organizer may also reduce the likelihood of signal contacts being damaged as the electrical connector is mounted to the circuit board. In addition to the above, the contact organizer may have signal windows that receive corresponding signal contacts and define air gaps between the signal contacts and inner surfaces of the contact organizer. The air gaps may be configured for the electrical connector assembly to obtain a target characteristic impedance and/or electrical performance. For example, the air gaps may eliminate an impedance discontinuity at the contact organizer thereby improving signal quality. In particular embodiments, the characteristic impedance is about 85 Ohm or about 100 Ohm, but the characteristic impedance may have other values in other embodiments.

Figure 1:
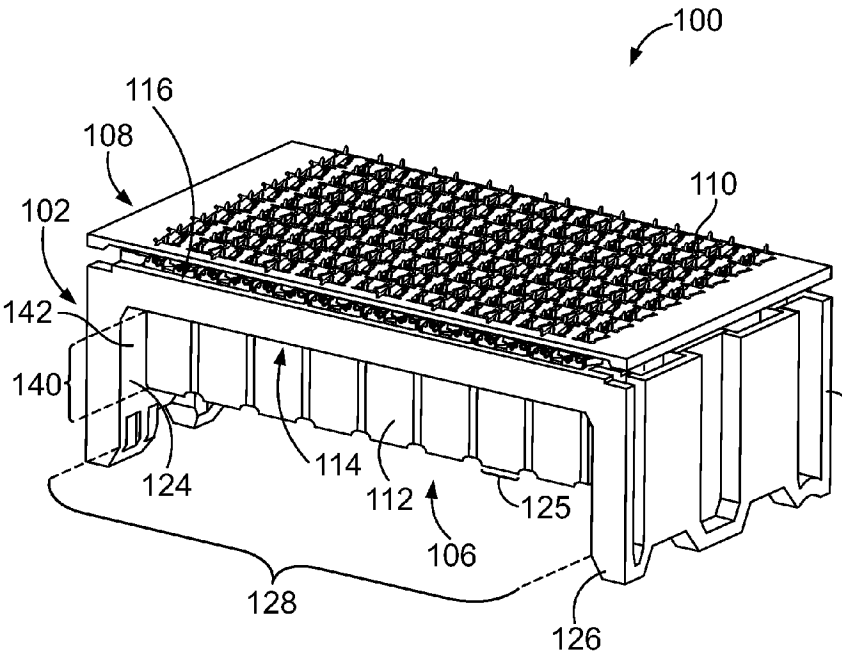
FIG. 1 is a perspective view of an electrical connector assembly formed in accordance with an embodiment.

FIG. 1 is a bottom perspective view of an electrical connector assembly 100 formed in accordance with an embodiment that includes an electrical connector 102 and a contact organizer 108 that is coupled to the electrical connector 102 in a pre-loaded position. The electrical connector 102 includes a connector housing 104 and an array 106 of electrical contacts 110, 112 that are coupled to the connector housing 104. The electrical contacts 110, 112 include signal contacts 110 that are configured to transmit data signals therethrough and ground contacts 112 that are configured to shield the signal contacts 110 from electromagnetic interference (EMI) during operation. In the pre-loaded position, the contact organizer 108 is engaged to the ground contacts 112, which collectively hold the contact organizer 108 through frictional forces. During a mounting operation, the contact organizer 108 is pressed against the connector housing 104. The electrical connector assembly 100 is configured to mate with another electrical connector (not shown), which may be referred to as a communication connector or data connector, during a mating operation.

Figure 7:
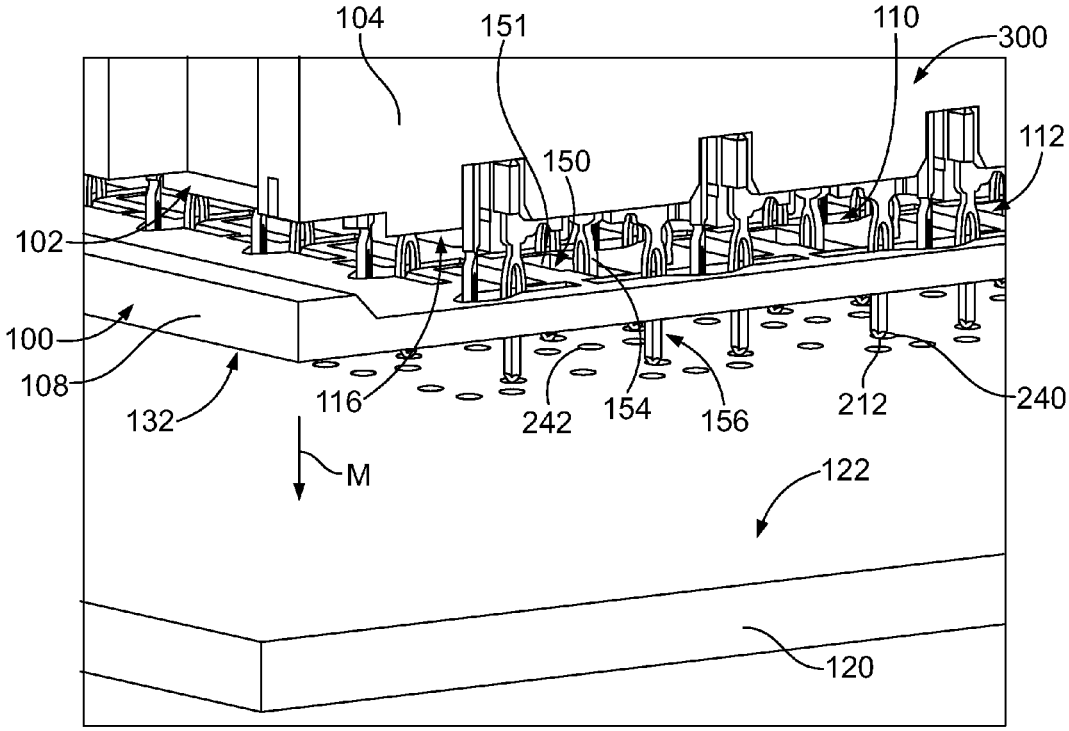
FIG. 7 is a perspective view of a portion of a circuit board assembly in accordance with an embodiment that may include the electrical connector assembly of FIG. 1.

The connector housing 104 has a mating side 114 that is configured to mate with the communication connector and a mounting side 116 that is configured to face a circuit board 120 (shown in FIG. 7). The circuit board 120 may be, for example, a motherboard or a daughter card. In the illustrated embodiment, the mating and mounting sides 114, 116 face in opposite directions. In other embodiments, however, the electrical connector assembly 100 may have a right-angle configuration in which the mating and mounting sides 114, 116 face in directions that are perpendicular to each other. When the electrical connector assembly 100 is mated to the communication connector, the mating side 114 may directly engage the communication connector. When the mounting side 116 is mounted to the circuit board 120, the contact organizer 108 is disposed between the mounting side 116 and an exterior surface 122 (shown in FIG. 7) of the circuit board 120.

The connector housing 104 includes opposing sidewalls 124, 126 that project away from mating side 114. The opposing sidewalls 124, 126 may define a connector-receiving space 128 therebetween. The connector-receiving space 128 is sized and shaped to receive the communication connector. The signal contacts 110 and the ground contacts 112 of the array 106 are disposed between the sidewalls 124, 126 within the connector-receiving space 128. The signal and ground contacts 110, 112 extend through the connector housing 104. The sidewalls 124, 126 have a height 140 that projects beyond a height 142 of the array 106. As such, the sidewalls 124, 126 may engage the communication connector before the signal contacts 110 and/or the ground contacts 112 engage the communication connector.

In particular embodiments, the signal contacts 110 are configured for differential signal communication. For example, the signal contacts 110 may be arranged in pairs in which each pair is surrounded by a corresponding ground contact 112 to form a contact assembly 125. The array 106 may include a plurality of such contact assemblies 125. For instance, the electrical connector 102 has an 8×8 array of the contact assemblies 125. In the illustrated embodiment, the electrical connector 102 is a vertical header connector. The communication connector may be a receptacle connector configured to mate with the header connector. The communication connector may be vertically oriented or, alternatively, may have a right-angle type configuration.

The electrical connectors and circuit board assemblies set forth herein may be used in various applications. By way of example only, embodiments may be used in telecom and computer applications, routers, servers, supercomputers, and uninterruptible power supply (UPS) systems. The circuit board assemblies may be backplane (or midplane) assemblies or daughter card assemblies that are configured to engage the backplane assemblies. One or more of the electrical connectors described herein may be similar to electrical connectors of the STRADA Whisper or Z-PACK TinMan product lines developed by TE Connectivity. For example, the signal lines of the electrical connectors may be capable of transmitting data signals at high speeds, such as 10 gigabits per second (Gb/s), 20 Gb/s, 30 Gb/s, or more. In more particular embodiments, the signal lines may be capable of transmitting data signals at 40 Gb/s, 50 Gb/s, or more. For some applications, the electrical connectors may include high-density, two-dimensional arrays of signal contacts. A high-density array may have, for example, at least 12 signal contacts per 100 $mm^2$. In more particular embodiments, the high-density array may have at least 20 signal contacts per 100 $mm^2$.

Figure 2:
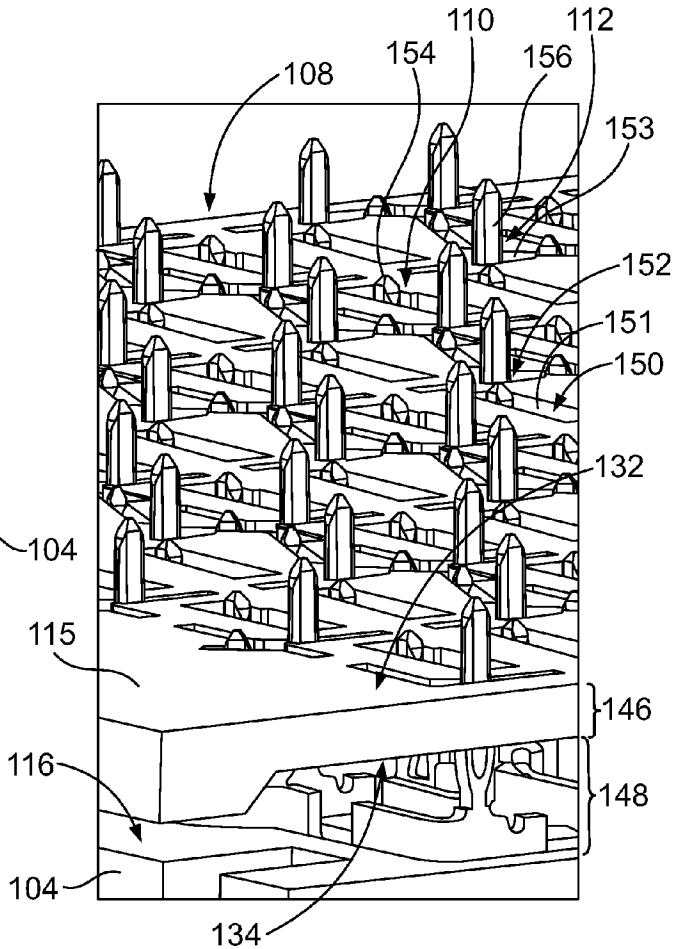
FIG. 2 is an enlarged perspective view of a portion of the electrical connector assembly of FIG. 1.

FIG. 2 is an enlarged view of a portion of the contact organizer 108 along the mounting side 116 of the connector housing 104. The contact organizer 108 has an organizer body 115 that extends across the mounting side 116. The organizer body 115 has a board side 132 and an opposite housing side 134 that are configured to engage the circuit board 120 (FIG. 7) and the connector housing 104, respectively. The organizer body 115 may have a thickness 146 measured between the board side 132 and the housing side 134. As shown, the contact organizer 108 is in the pre-loaded position and is spaced apart from the connector housing 104 such that a gap 148 exists between the mounting side 116 of the connector housing 104 and the housing side 134 of the contact organizer 108. In some embodiments, the electrical connector assembly 100 (FIG. 1) may be assembled and shipped with the contact organizer 108 in the pre-loaded position. The contact organizer 108 is configured to directly engage the connector housing 104 when the electrical connector assembly 100 is in a mounted position (shown in FIG. 8) with respect to the circuit board 120 (FIG. 7). The contact organizer 108 has a seated position (shown in FIG. 8) when the contact organizer 108 directly engages the connector housing 104.

Figure 5:
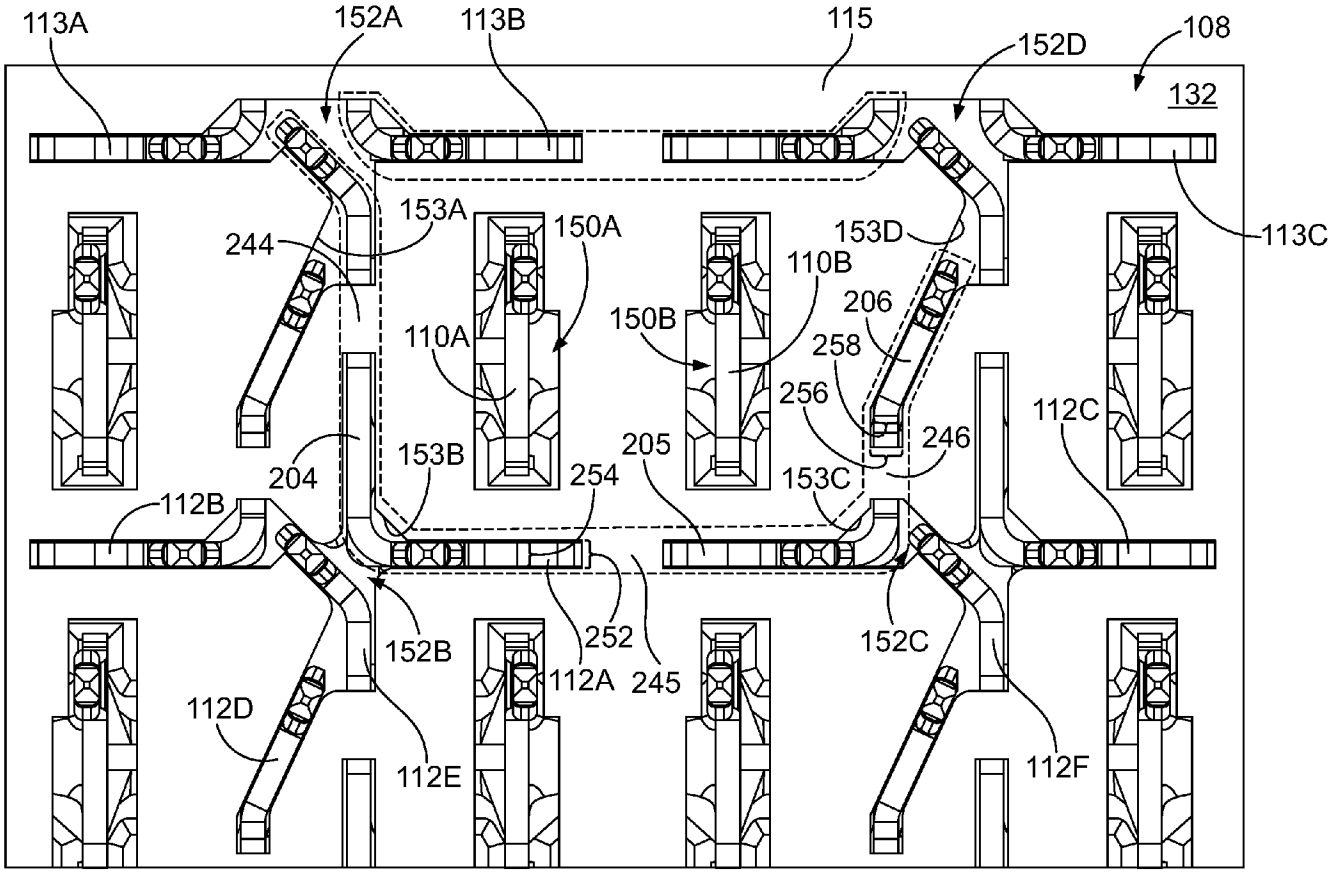
FIG. 5 is a plan view of a portion of the electrical connector assembly of FIG. 1 illustrating the signal contacts and the ground contacts disposed in signal windows and ground passages, respectively.

The contact organizer 108 includes signal windows 150 and ground passages 152 that extend through the thickness 146 between the board and housing sides 132, 134. The signal windows 150 and the ground passages 152 are defined by respective inner surfaces 151, 153 of the organizer body 115. For reference, the signal windows 150 and the ground passages 152 are also shown in FIG. 5. The signal contacts 110 include contact tails 154 that are configured to extend into and through the signal windows 150. The ground contacts 112 include contact tails 156 that are configured to extend into and through the ground passages 152. To more easily distinguish the contact tails 154, 156, the contact tails may be referred to as signal tails and ground tails, respectively. The contact tails 154, 156 are configured to clear or extend beyond the board side 132. In particular embodiments, the contact tails 154, 156 are compliant or press-fit pins, such as eye-of-needle (EON) pins or action pins.

In FIG. 2, at least some of the ground contacts 112 are engaged to the inner surfaces 153 thereby generating frictional forces that resist or impede movement. Collectively, the frictional forces may hold the contact organizer 108 in the pre-loaded position with respect to the connector housing 104. For example, in some embodiments, the electrical connector assembly 100 may have any orientation with respect to gravity and the frictional forces may hold the contact organizer 108 in the pre-loaded position. As the electrical connector assembly 100 is mounted to the circuit board 120 (FIG. 7), the contact organizer 108 moves from the pre-loaded position to the seated position. In the seated position, the contact organizer 108 engages the connector housing 104 such that the housing side 134 of the organizer body 115 directly engages the mounting side 116 of the connector housing 104. Also shown in FIG. 2, the ground contacts 112 extend further away from the board side 132 than the signal contacts 110. The ground contacts 112 are configured to engage the circuit board 120 before the signal contacts 110 engage the circuit board 120.

Figure 3:
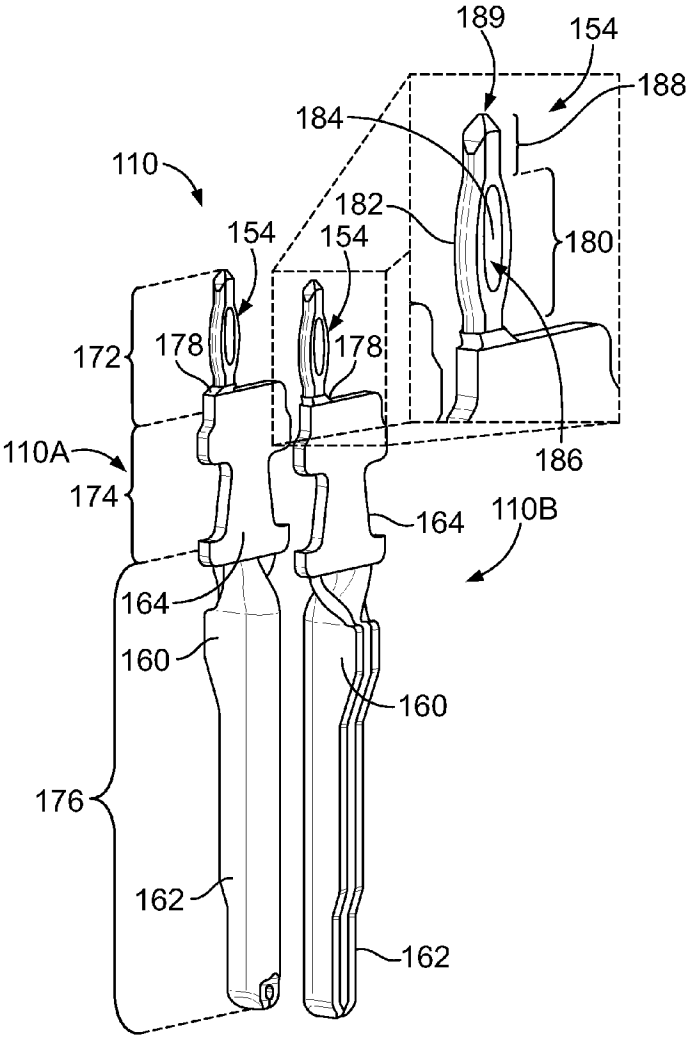
FIG. 3 is a perspective view of a pair of signal contacts that may be used with the electrical connector assembly of FIG. 1.

FIG. 3 is a perspective view of a pair of the signal contacts 110, which are referenced individually as signal contacts 110A, 110B. In FIG. 3, the signal contacts 110A, 110B are positioned relative to each other as the signal contacts 110A, 110B would be positioned when operational in the electrical connector 102 (FIG. 1). Each of the signal contacts 110A, 110B has a contact body 160 that includes the contact tail 154, a mating pin or extension 162, and a contact base 164 that extends between and joins the contact tail 154 and the mating pin 162. The contact tail 154 is configured to be inserted into a via 242 (shown in FIG. 7), such as a plated thru-hole (PTH), and mechanically engage conductive material of the via 242. The mating pin 162 is configured to engage a corresponding electrical contact (not shown) of the communication connector. For example, the mating pin 162 may be inserted into a socket of the communication connector.

In FIG. 3, the contact base 164 is a flat or planar sheet of conductive material, but the contact base 164 may have other configurations in other embodiments. In the illustrated embodiment, the contact body 160 is stamped and formed from a sheet of conductive material such that the corresponding signal contact 110 provides a single continuous signal pathway. In other embodiments, however, the signal contacts 110A, 110B may be constructed from a plurality of discrete conductive elements that are coupled to one another to form a signal pathway.

The contact tails 154 are coupled to the corresponding contact base 164 through a corresponding joint 178. Each of the joints 178 may be shaped to position the corresponding contact tail 154 so that the contact tail 154 and the corresponding contact base 164 are offset. For example, in the illustrated embodiment, as the joints 178 extend away from the corresponding contact bases 164, the joints 178 extend toward each other. As such, the contact tails 154 of the signal contacts 110A, 110B are closer to each other than the contact bases 164 of the signal contacts 110A, 110B.

Although the following is with reference to the signal contact 110A, the description may be similarly applied to the signal contact 110B. The signal contact 110A includes a mounting portion 172, a housing portion 174, and a mating portion 176. The mounting portion 172 is configured to project beyond the mounting side 116 (FIG. 1). The mounting portion 172 includes the entire contact tail 154, the joint 178, and, optionally, a portion of the contact base 164. The housing portion 174 is configured to engage and be surrounded by the connector housing 104 (FIG. 1). For instance, the housing portion 174 may be shaped relative to a cavity (not shown) of the connector housing 104 to form an interference fit with the connector housing 104 when inserted into the cavity. The housing portion 174 may include a majority of the contact base 164. The mating portion 176 is configured to extend into the connector-receiving space 128 (FIG. 1) and may include a majority of or an entirety of the mating pin 162. In some embodiments, the mating portion 176 may include a portion of the contact base 164.

With reference to the enlarged portion in FIG. 3, each of the contact tails 154 may have a compliant portion 180 that includes legs 182, 184 that oppose each other with a hole 186 therebetween. In the illustrated embodiment, the legs 182, 184 may be deflected toward each other when the contact tail 154 is inserted into the via 242 (FIG. 7). Each of the contact tails 154 also includes a leading beam 188. The leading beam 188 projects from the compliant portion 180 and is configured to lead the contact tail 154 into the via 242 of the circuit board 120 (FIG. 7). The leading beam 188 includes a distal tip 189, which includes or represents the furthest point of the contact tail 154 from the connector housing 104.

Figure 4:
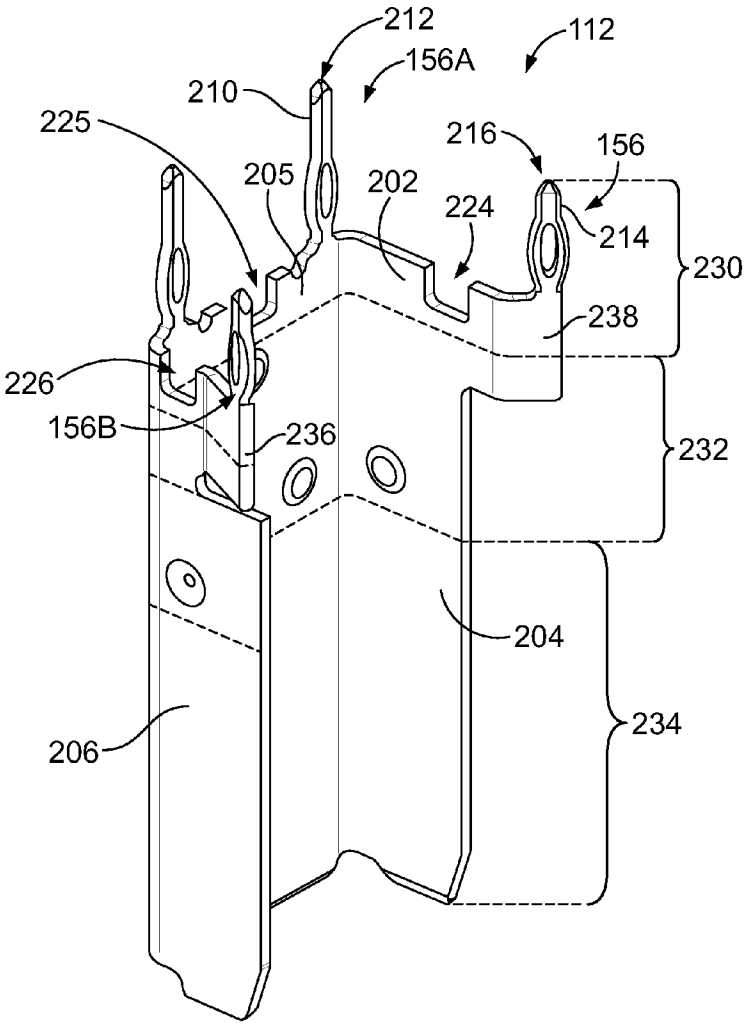
FIG. 4 is a perspective view of a ground contact that may be used with the electrical connector assembly of FIG. 1.

FIG. 4 is a perspective view of the ground contact 112. The ground contact 112 includes a contact body 202 that is shaped to surround the pair of signal contacts 110A and 110B (FIG.

3) and form a contact assembly 125 (FIG. 1). Each of the ground contacts 112 may reduce crosstalk between adjacent pairs of the signal contacts 110A, 110B. As shown in FIG. 4, the contact body 202 may be C-shaped. In other embodiments, the contact body 202 may be L-shaped or have another configuration. The contact body 202 includes a plurality of shield walls 204, 205, and 206. The shield walls 204 and 206, which may be referred to as side shield walls, are joined by the shield wall 205, which may be referred to as a base shield wall. In the illustrated embodiment, the shield walls 204-206 have substantially planar bodies.

The ground contact 112 includes a plurality of contact tails 156A, 156B. The shield wall 205 includes a pair of the contact tails 156A and the shield walls 204 and 206 each include a contact tail 156B. The contact tails 156A have leading beams 210 that extend to corresponding distal tips 212, and the contact tails 156B have leading beams 214 that extend to corresponding distal tips 216. When the electrical connector assembly 100 (FIG. 1) is fully constructed, the distal tips 212 extend further away from the contact organizer 108 (FIG. 1) than the distal tips 216 and further away from the contact organizer 108 than the distal tips 189 (FIG. 3). During a mounting operation, the distal tips 212 engage the circuit board 120 (FIG. 7) before the distal tips 216 and the distal tips 189 engage the circuit board 120. Also shown, the shield walls 204-206 have corresponding notches 224-226. The notches 224-226 are configured to receive portions of the contact organizer 108.

Similar to the signal contacts 110A, 110B (FIG. 3), the ground contact 112 may include a mounting portion 230, a housing portion 232, and a mating portion 234, which are indicated by dashed lines across the contact body 202 in FIG. 4. The housing portion 232 is the portion of the ground contact 112 that directly engages the connector housing 104 (FIG. 1), and the mating portion 234 is the portion of the ground contact 112 that is disposed within the connector-receiving space 128 (FIG. 1) for mating with the communication connector (not shown). The mating portion 234 may project away from the mating side 114 (FIG. 1) of the connector housing 104 (FIG. 1) and at least partially surround the pair of the signal contacts 110A, 110B.

The mounting portion 230 is the portion of the ground contact 112 that projects from the housing side 116 (FIG. 1) and is configured to engage the contact organizer 108 and/or the circuit board 120. The mounting portion 230 may include the contact tails 156A, 156B and portions of the shield walls 204-206. The mounting portion 230 may include shield wings 236, 238. The shield wing 236 is part of the shield wall 206, and the shield wing 238 is part of the shield wall 204. Each of the shield wings 236, 238 is not co-planar with respect to a remainder of the corresponding shield wall. In some embodiments, the mounting portion 230 directly engages the contact organizer 108 when the contact organizer 108 is in the seated position or in the pre-loaded position. In some embodiments, the mounting portion 230 directly engages the contact organizer 108 as the contact organizer 108 moves from the pre-loaded position to the seated position.

FIG. 5 is an enlarged plan view of a portion of the board side 132 of the contact organizer 108 when the contact organizer 108 is in the pre-loaded position. In particular, FIG. 5 shows signal windows 150A, 150B surrounded by ground passages 152A, 152B, 152C, 152D. The signal contacts 110A, 110B are disposed within the signal windows 150A, 150B, respectively, and ground contacts 112A, 112B, 112C, 112D, 112E, 112F, and ground shields 113A, 113B, 113C are disposed within corresponding ground passages as described below. The ground shields 113A-113C are part of the array 106 (FIG. 1) and may be similar to the ground contacts 112A-112E. However, in the illustrated embodiment, the ground shields 113A-113C do not include side shield walls that are similar to the shield walls 204, 206.

For clarity, the ground contact 112A is surrounded by a dashed line and the ground shield 113B is surrounded by a dashed line. The ground contact 112A and the ground shield 113B effectively surround the signal contacts 110A, 110B to shield the signal contacts 110A, 110B from EMI.

The ground passages 152A, 152B, 152C, 152D are defined by respective inner surfaces 153A, 153B, 153C, 153D. As shown, the ground passages 152A-152D may have irregular shapes that are configured to receive portions of different ground contacts. For instance, the ground passages 152B and 152C are substantially X-shaped. The ground passage 152B includes portions of the ground contacts 112A, 112B, 112D, and 112E, and the ground passage 152C includes portions of the ground contacts 112A, 112C, 112E, and 112F. The ground passages 152A and 152D are substantially Y-shaped. The ground passage 152A includes portions of the ground contacts 112A, 112B, and portions of the ground shields 113A, 113B. The ground passage 152D includes portions of the ground contacts 112A, 112C, and portions of the ground shields 113B, 113C. Thus, each ground passage 152A-152D may be sized and shaped to receive more than one ground contact. In other embodiments, at least some of the ground passages may be sized and shaped to receive only one ground contact.

Accordingly, the ground contact 112A is disposed within each of the ground passages 152A-152D. More specifically, the shield wall 205 is disposed within the ground passages 152B, 152C, the shield wall 204 is disposed within the ground passages 152A, 152B, and the shield wall 206 is disposed within the ground passages 152C, 152D. The ground passages 152A and 152B are separated by a bridge portion 244 of the organizer body 115 that extends through the notch 224 (FIG. 4) of the ground contact 112A. The ground passages 152B and 152C are separated by a bridge portion 245 of the organizer body 115 that extends through the notch 225 (FIG. 4) of the ground contact 112A, and the ground passages 152C and 152D are separated by a bridge portion 246 of the organizer body 115 that extends through the notch 226 (FIG. 4) of the ground contact 112A.

In some embodiments, the ground passages are sized and shaped with respect to the portions of the ground contacts that are within the ground passages such that the ground contacts are held in substantially fixed positions with respect to the contact organizer. For example, the ground passages 152A-152D are sized and shaped with respect to portions of the ground contact 112A such that the ground contact 112A is collectively held by the corresponding inner surfaces 153A-153D in a substantially fixed position. The ground contact 112A may form a snug fit or an interference fit with the inner surfaces 153A-153D. More specifically, the ground contact 112A may engage each of the inner surfaces 153A-153D at one or more points to generate frictional forces that resist or impede movement of the contact organizer 108 away from either the seated or pre-loaded position. In some embodiments, the frictional forces that hold the contact organizer 108 in the seated position are greater than the frictional forces that hold the contact organizer 108 in the pre-loaded position.

For example, the ground passage 152B has a width 252 that is substantially equal to or slightly greater than a thickness 254 of the shield wall 205, and the ground passage 152D has a width 256 that is substantially equal to or slightly greater than a thickness 258 of the shield wall 206. The shield walls 205, 206 may directly engage one or more points of the inner surfaces 153B, 153D, respectively. Because the shield walls 205, 206 are oriented non-parallel with respect to each other, the ground contact 112A may be substantially immovable in any direction that is parallel to the board side 132. Accordingly, the ground contact 112A is held in a substantially fixed position with respect to the organizer body 115 when the contact organizer 108 is in the seated position. In some embodiments, the ground contact 112A is held in a substantially fixed position with respect to the organizer body 115 when the contact organizer 108 is in the pre-loaded position.

Figure 6:
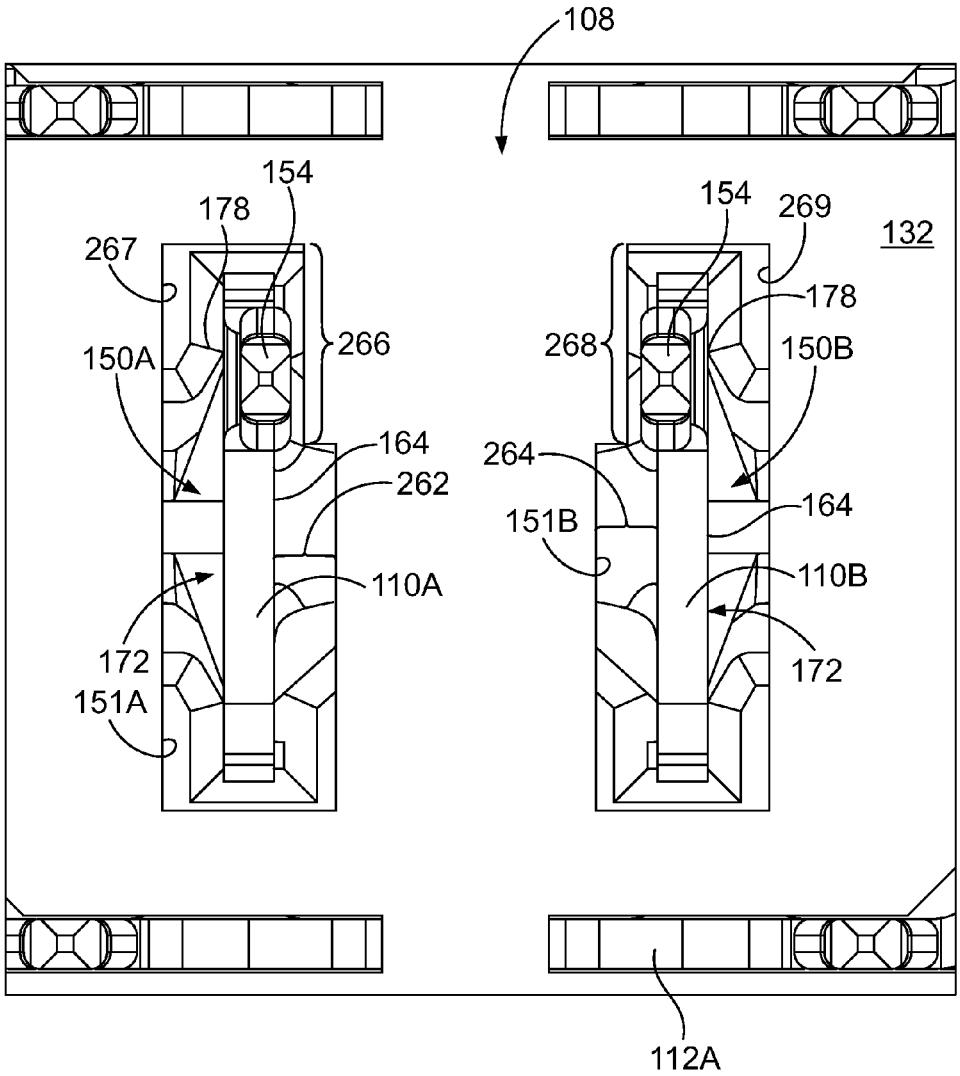
FIG. 6 is an enlarged plan view of the electrical connector assembly illustrating the signal windows and signal contacts in greater detail.

FIG. 6 is an enlarged plan view of the board side 132 of the contact organizer 108 illustrating the signal windows 150A, 150B in greater detail. The signal windows 150A, 150B are oversized with respect to the signal contacts 110A, 110B, respectively, to permit the signal contacts 110A, 110B to move freely through the contact organizer 108 when the contact organizer 108 moves from the pre-loaded position to the seated position. When the contact organizer 108 is in the seated position, the contact tails 154 of the signal contacts 110A, 110B have substantially cleared the board side 132 and the corresponding contact bases 164 are positioned within the corresponding signal window. The signal windows 150A, 150B are also oversized relative to the signal contacts 110A, 110B, respectively, such that air gaps surround the signal contacts 110A, 110B. More specifically, an air gap 262 exists between an inner surface 151A that defines the signal window 150A and the mounting portion 172 of the signal contact 110A that is positioned within the signal window 150A. The mounting portion 172 of the signal contact 110A may include at least one of the corresponding joint 178 or the corresponding contact base 164. Likewise, an air gap 264 exists between an inner surface 151B that defines the signal window 150B and the mounting portion 172 of the signal contact 110B that is positioned within the signal window 150B. The mounting portion 172 of the signal contact 110B includes at least one of the corresponding joint 178 or the contact base 164.

While the electrical connector assembly 100 (FIG. 1) is mounted to the circuit board 120 (FIG. 7) and transmitting data signals, the air gaps 262, 264 exist between the signal contacts 110A, 110B, respectively, and the dielectric material of the contact organizer 108. In some embodiments, the air gaps 262, 264 are dimensioned such that the electrical connector assembly 100 achieves a designated characteristic impedance. The designated characteristic impedance may be, but not limited to, about 85 Ohm or about 100 Ohm. By way of example only, the air gaps 262, 264 may range between 0.04 mm and 0.25 mm. In more particular embodiments, the air gaps 262, 264 may range between 0.06 mm and 0.18 mm.

As shown in FIG. 6, dimensions of the air gaps 262, 264 may not be uniform around the respective signal contacts 110A, 110B. For instance, in the illustrated embodiment, the inner surface 151A has a tail-directing area 266 and a window area 267. The tail-directing area 266 of the inner surface 151A is located closer to the contact base 164 of the signal contact 110A than the window area 267 of the inner surface 151A. In the illustrated embodiment, the tail-directing area 266 is a single flat portion of the inner surface 151A and the window area 267 includes multiple flat portions of the inner surface 151A that face the signal contact 110A. The window area 267 constitutes a majority of the inner surface 151A surrounding the signal contact 110A. As shown, the air gap 262 along the window area 267 is greater than the air gap 262 along the tail-directing area 266. The air gap 264 may have a shape that is similar to a shape of the air gap 262. For example, the inner surface 151B has a tail-directing area 268 and a window area 269. The tail-directing area 268 of the inner surface 151B is located closer to the contact base 164 of the signal contact 110B than the window area 269 of the inner surface 151B.

In some embodiments, the tail-directing areas 266, 268 may operate to locate the corresponding contact tails 154 during the mounting operation. However, because the contact tails 154 are offset with respect to the corresponding contact bases 164, the tail-directing areas 266, 268 are located further away from the corresponding contact bases 164 than from the corresponding contact tails 154. In some embodiments, as the electrical connector assembly 100 (FIG. 1) is mounted onto the circuit board 120 (FIG. 7), the corresponding contact tails 154 may slidably engage the tail-directing areas 266, 268. The tail-directing areas 266, 268 may prevent the contact tails 154 from becoming misaligned with respect to the corresponding vias 242 (FIG. 7) during the mounting operation. The tail-directing areas 266, 268 may also prevent the contact tails 154 from bending or buckling when engaging the circuit board 120.

By way of example only, the air gaps 262, 264 between the contact bases 164 and the respective tail-directing areas 266, 268 when the contact organizer 108 is in the seated position may be between about 0.04 mm to about 0.14 mm or, more specifically, between about 0.04 mm to about 0.10 mm. The air gaps 262, 264 between the contact bases 164 and the respective window areas 267, 269 may be between about 0.10 mm to about 0.20 mm or, more specifically, between about 0.12 mm to about 0.18 mm. As described herein, the air gaps 262, 264 may be configured to obtain a designated characteristic impedance for the electrical connector assembly 100 (FIG. 1).

FIG. 7 illustrates a circuit board assembly 300 in accordance with an embodiment that includes the electrical connector assembly 100. In particular, FIG. 7 shows the electrical connector assembly 100 prior to being mounted to the circuit board 120. The contact organizer 108 is in the pre-loaded position. The electrical connector assembly 100 is configured to be moved in a mounting direction M toward the exterior surface 122 of the circuit board 120.

In some embodiments, at least some of the contact tails 156 of the ground contacts 112 extend further away from the mounting side 116 of the connector housing 104 (or the board side 132 of the organizer 108) than the contact tails 154 of the signal contacts 110. For example, as shown in FIG. 7, the distal tips 212 of the ground contacts 112 are against the exterior surface 122 of the circuit board 120. The distal tips 189 (FIG. 3) of the signal contacts 110, on the other hand, are spaced apart from the exterior surface 122. In the pre-loaded position, the contact organizer 108 surrounds and protects the contact tails 154 of the signal contacts 110. As described herein, the signal windows 150 are oversized such that the contact organizer 108 does not directly engage at least some of the contact tails 154. The contact organizer 108, however, directly engages the contact tails 156 of the ground contacts 112, thereby holding the ground contacts 112 in a predetermined arrangement with respect to one another and reinforcing the ground contacts 112 to protect the ground contacts 112 from damage.

For example, during the mounting operation, the ground contacts 112 may be misaligned with respect to the vias 240 and engage the exterior surface 122. When the ground contacts 112 engage the exterior surface 122, the resistance and/or friction between the ground contacts 112 and the exterior surface 122 may provide a tactile indication to a user that the electrical connector 102 is misaligned with respect to the circuit board 120. The user may then move the electrical connector 102 in a lateral direction along the exterior surface 122 until the distal tips 212 are received within the corresponding vias 240. At this time, the ground contacts 112 may be gripped by the contact organizer 108 to prevent the ground contacts 112 from becoming damaged. Also at this time, the distal tips 189 of the signal contacts 110 are spaced from the exterior surface 122 and consequently protected from damage. In such embodiments, the distal tips 189 engage the vias 242 only after the ground contacts 112 are sufficiently aligned with and enter the vias 240.

As the distal tips 212 of the ground contacts 112 advance into the corresponding vias 240, the board side 132 of the contact organizer 108 may engage the exterior surface 122 thereby preventing further movement of the contact organizer 108 in the mounting direction M. The frictional forces generated between the contact tails 156 and the contact organizer 108 may be overcome and the mounting side 116 of the connector housing 104 may begin to move toward the contact organizer 108 and the circuit board 120. Because the ground contacts 112 have already been aligned and received within the corresponding vias 240, the distal tips 189 of the signal contacts 110 should be substantially aligned with corresponding vias 242. The contact tails 154 of the signal contacts 110 may move freely through the corresponding signal windows 150 without resistance from the corresponding inner surfaces 151 as the contact organizer 108 moves, relative to the electrical connector 102, from the pre-loaded position to the seated position. In such embodiments, the tail-directing areas 266, 268 (FIG. 6) may slidably engage the contact tails 154 to prevent the contact tails 154 from becoming misaligned. The tail-directing areas 266, 268, however, only engage one side of the corresponding contact tails 154 and, as such, do not block or impede the movement of the contact tails 154. The signal contacts 110 may then be received by the corresponding vias 242.

Figure 8:
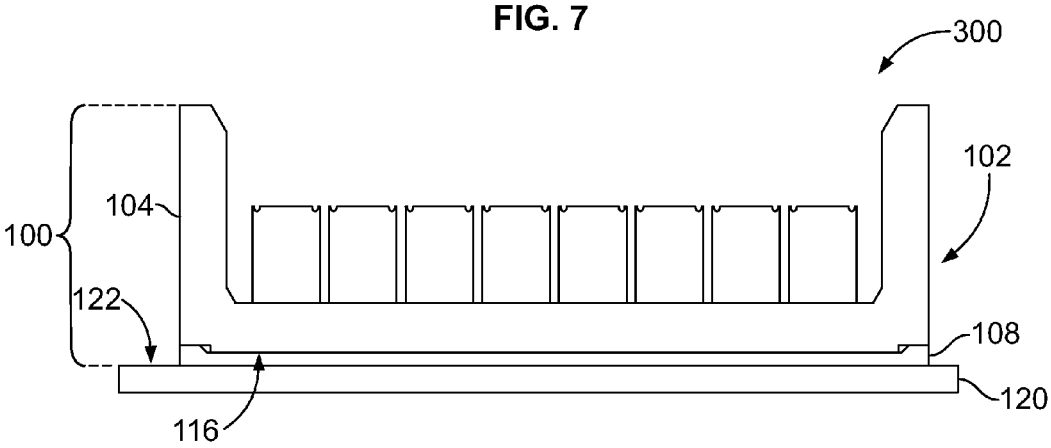
FIG. 8 is a side view of the circuit board assembly of FIG. 7 when the electrical connector assembly is in a mounted position with respect to a circuit board.

FIG. 8 illustrates the circuit board assembly 300 in which the electrical connector assembly 100 is in a mounted position with the contact organizer 108 in the seated position between the electrical connector 102 and the circuit board 120. As described above, the signal contacts 110 (FIG. 1) extend through the signal windows 150 (FIG. 2) of the contact organizer 108, and the air gaps 262, 264 (FIG. 6) exist between the corresponding signal contacts 110 and the inner surfaces 151 (FIG. 2) of the signal windows 150. The air gaps 262, 264 may be dimensioned to allow the electrical connector 102 and the circuit board assembly 300 to operate at a designated characteristic impedance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector assembly comprising:

an electrical connector including a connector housing having a mating side configured to mate with a communication connector and a mounting side configured to face a circuit board, the electrical connector including signal contacts and ground contacts coupled to the connector housing and disposed along the mounting side; and a contact organizer positioned along the mounting side of the connector housing, the contact organizer having signal windows and ground passages extending therethrough that are defined by respective inner surfaces of the contact organizer, the ground contacts engaging the inner surfaces of the ground passages when the contact organizer is held in a pre-loaded position away from the mounting side, the contact organizer moving to a seated position against the mounting side when the electrical connector is mounted to the circuit board, each of the signal contacts being surrounded by an air gap that exists between the corresponding signal contact and the inner surface of the corresponding signal window when the contact organizer is in the seated position.

2. The electrical connector assembly of claim 1, wherein at least some of the ground contacts have contact tails and at least some of the signal contacts have contact tails, the contact tails of the ground contacts extending further away from the mounting side than the contact tails of the signal contacts.

3. The electrical connector assembly of claim 1, wherein the ground contacts have mating portions, each of the mating portions projecting away from the mating side of the connector housing and at least partially surrounding a pair of the signal contacts.

4. The electrical connector assembly of claim 1, wherein at least some of the signal contacts include mounting portions, each of the mounting portions having a contact base and a contact tail that projects from the contact base, the contact tail configured to be inserted into a via of the circuit board, the contact tail being disposed within the corresponding signal window when the contact organizer is in the pre-loaded position and extending from the contact organizer for insertion into the via when the contact organizer is in the seated position.

5. The electrical connector assembly of claim 4, wherein the contact tails of the signal contacts move freely through the corresponding signal windows without resistance from the corresponding inner surfaces when the contact organizer moves from the pre-loaded position to the seated position.

6. The electrical connector assembly of claim 1, wherein the air gap exists between the corresponding signal contact and the inner surface of the corresponding signal window when the contact organizer is in the pre-loaded position.

7. The electrical connector assembly of claim 1, wherein the air gap is between 0.08 mm and 0.20 mm when the contact organizer is in the seated position, the air gap configured to obtain a characteristic impedance of about 85 Ohm or about 100 Ohm.

8. The electrical connector assembly of claim 1, wherein the signal and ground contacts form an array of contact assemblies, each of the contact assemblies having one of the ground contacts and a pair of the signal contacts, the ground contact of each contact assembly at least partially surrounding the corresponding pair of the signal contacts.

9. The electrical connector assembly of claim 1, wherein the ground contacts include contact tails that frictionally engage the corresponding inner surfaces of the contact organizer when the contact organizer is in the pre-loaded position, the contact tails collectively holding the contact organizer in the pre-loaded position, the contact tails configured to be inserted into corresponding vias of the circuit board when the contact organizer is in the seated position.

10. The electrical connector assembly of claim 1, wherein at least some of the ground contacts are C-shaped and include a plurality of contact tails for engaging the circuit board.

11. An electrical connector assembly comprising:

an electrical connector including a connector housing having a mating side configured to mate with a communication connector and a mounting side configured to face a circuit board, the electrical connector including signal contacts and ground contacts coupled to the connector housing and disposed along the mounting side; and a contact organizer positioned along the mounting side of the connector housing, the contact organizer having signal windows and ground passages extending therethrough that are defined by respective inner surfaces of the contact organizer;

wherein the contact organizer is configured to move from a pre-loaded position, in which the contact organizer is separated from the mounting side, to a seated position, in which the contact organizer is located against the mounting side, the ground contacts being held in a designated arrangement as the contact organizer moves from the pre-loaded position to the seated position, at least some of the signal contacts moving freely through the corresponding signal windows without resistance from the corresponding inner surfaces as the contact organizer moves from the pre-loaded position to the seated position.

12. The electrical connector assembly of claim 11, wherein at least some of the ground contacts have contact tails and at least some of the signal contacts have contact tails, the contact tails of the ground contacts extending further away from the mounting side than the contact tails of the signal contacts.

13. The electrical connector assembly of claim 11, wherein the ground contacts have mating portions, each of the mating portions projecting away from the mating side of the connector housing and at least partially surrounding a pair of the signal contacts.

14. The electrical connector assembly of claim 11, wherein at least some of the signal contacts include mounting portions, each of the mounting portions having a contact base and a contact tail that projects from the contact base, the contact tail configured to be inserted into a via of the circuit board, the contact tail being disposed within the corresponding signal window when the contact organizer is in the pre-loaded position and extending from the contact organizer for insertion into the via when the contact organizer is in the seated position.

15. The electrical connector assembly of claim 11, wherein the inner surfaces for at least some of the signal windows have a tail-directing area and a window area, wherein a size of the air gap between the signal contact and the tail-directing area is less than a size of the air gap between the signal contact and the window area.

16. The electrical connector assembly of claim 11, wherein the air gap is between 0.08 mm and 0.20 mm when the contact organizer is in the seated position, the air gap configured to obtain a characteristic impedance of about 85 Ohm or about 100 Ohm.

17. The electrical connector assembly of claim 11, wherein the signal contacts and the ground contacts form an array of contact assemblies, each of the contact assemblies having one of the ground contacts and a pair of the signal contacts, the ground contact of each contact assembly at least partially surrounding the corresponding pair of the signal contacts.

18. A circuit board assembly comprising: a circuit board having an exterior surface and an array of vias extending into the exterior surface; and an electrical connector including a connector housing having a mating side configured to mate with a communication connector and a mounting side facing the circuit board, the electrical connector including signal contacts and ground contacts coupled to the connector housing, the signal and ground contacts being disposed along the mounting side and inserted into corresponding vias of the circuit board; and a contact organizer positioned between the mounting side of the connector housing and the circuit board, the contact organizer having signal windows and ground passages extending therethrough that are defined by respective inner surfaces of the contact organizer, the ground contacts engaging the inner surface of the ground passages and the signal contacts extending through the signal windows, each of the signal contacts being surrounded by an air gap that exists between the signal contact and the inner surface of the corresponding signal window when the electrical connector is mounted to the circuit board.

19. The circuit board assembly of claim 18, wherein at least some of the ground contacts have contact tails and at least some of the signal contacts have contact tails, the contact tails of the ground contacts extending further away from the mounting side than the contact tails of the signal contacts.

20. The circuit board assembly of claim 18, wherein the air gap is between 0.08 mm and 0.20 mm when the contact organizer is in the seated position, the air gap configured to obtain a characteristic impedance of about 85 Ohm or about 100 Ohm.

* * * * *